US007445523B2

(12) United States Patent
Onoda et al.

(10) Patent No.: US 7,445,523 B2
(45) Date of Patent: Nov. 4, 2008

(54) CONNECTOR

(75) Inventors: Katsuhiko Onoda, Makinohara (JP); Tomokazu Yamane, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/703,653

(22) Filed: Feb. 8, 2007

(65) Prior Publication Data

US 2007/0218780 A1 Sep. 20, 2007

(30) Foreign Application Priority Data

Mar. 17, 2006 (JP) ..... 2006-075219

(51) Int. Cl.
*H01R 13/514* (2006.01)

(52) U.S. Cl. ..... 439/752; 439/595

(58) Field of Classification Search ..... 439/752, 439/595, 701, 871

See application file for complete search history.

(56) References Cited

U.S. PATENT DOCUMENTS 5,122,080 A * 6/1992 Hatagishi et al. ..... 439/595
5,613,868 A * 3/1997 Ohsumi et al. ..... 439/275
6,146,200 A * 11/2000 Ito et al. ..... 439/596
6,527,574 B1 * 3/2003 Murakami et al. ..... 439/275
6,764,334 B2 * 7/2004 Tsuji et al. ..... 439/595
7,097,503 B2 * 8/2006 Tsuji ..... 439/595

FOREIGN PATENT DOCUMENTS

JP 8-288017 A 11/1996

* cited by examiner

*Primary Examiner*—Tho D. Ta
*Assistant Examiner*—Travis Chambers
(74) *Attorney, Agent, or Firm*—Sughrue Mion, PLLC

(57) ABSTRACT

A connector includes an inner housing receiving terminals, and an outer housing which is attached to the inner housing in a direction of insertion of the terminals into the inner housing. The outer housing includes pressing portions which abut against or are closely opposed to the respective terminals, received in their respective predetermined positions within the inner housing, in the direction of attaching of the outer housing.

1 Claim, 5 Drawing Sheets

CONNECTOR

BACKGROUND OF THE INVENTION

1. Field of the Invention

This invention relates to a connector, and more particularly to a connector designed to prevent half-insertion of terminals.

2. Related Art

There is known a conventional connector of the type in which detection is made to determine whether or not any of terminals received in terminal receiving chambers is in a half-inserted condition (see, for example, JP-A-8-288017 Publication).

As shown in FIG. 10, the connector 100 disclosed in Patent Literature 1 comprises a housing 101 for receiving terminals, and a front holder 102 attached to the housing 101 from a front side of this housing 101. The front holder 102 has strip-like half-insertion detection portions 103 and 104 extending toward a rear end of the housing 101.

An elastic retaining arm 114 is provided in each terminal receiving chamber 105 of the housing 101, and retains the terminal received in the terminal receiving chamber. A flexure space 115 is provided above the terminal retaining arm 114. As the front holder 102 is attached to the housing 101, the half-insertion detection portions 103 and 104 enter the flexure spaces 115, respectively.

Here, if the terminal is half inserted in the terminal receiving chamber 105, the elastic retaining arm 114 interferes with the terminal, and can not be restored into its initial condition, and therefore is kept projecting into the flexure space 115. The half-insertion detection portion 103, 104 of the front holder 102 is guided by a slanting surface formed at a distal end of the elastic retaining arm 114 projecting into the flexure space 115, and is brought into abutting engagement with an abutment surface formed at an upper edge of an opening of the flexure space 115, and therefore is prevented from entering the flexure space 115. Therefore, the front holder 102 can not be attached to the housing 101, and thus the half-inserted condition of the terminal can be detected.

However, in the connector disclosed in JP-A-8-288017 Publication, although a half-inserted condition of the terminal can be detected, the terminal can be not be inserted into a predetermined position within the terminal receiving chamber through the operation of the front holder. And besides, it can not be determined which terminal is in the half-inserted condition. Therefore, it is necessary to again push the individual terminals respectively into the terminal receiving chambers, and therefore the efficiency of the assembling operation is low.

Typically, a terminal has at its distal end portion a contact portion for contact with a mating terminal, and its proximal end portion is connected to a wire, a circuit on a printed circuit board or the like, and is more flatten or thinner as compared with the contact portion. The connector disclosed in JP-A-8-288017 Publication is of such a construction that the terminals are inserted into the housing 101 from the rear side thereof. Therefore, the terminal is inserted into the housing 101 with the contact portion first introduced into the housing 101, and the terminal receiving chamber 105 is formed into a size corresponding to the size of the contact portion so that the contact portion can pass through the terminal receiving chamber 105. As a result, the proximal end portion of the terminal received in the terminal receiving chamber 105 is not restrained by partition walls forming the terminal receiving chamber since this proximal end portion is is more flattened or thinner as compared with the contact portion, and therefore the proximal end portion can be easily shaken or jarred by external vibrations or others, and there is a fear that the connection of the terminal to the wire, the circuit on the board or the like may be adversely affected.

SUMMARY OF THE INVENTION

This invention has been made in view of the above circumstances, and an object of the invention is to provide a connector which is excellent in efficiency of an assembling operation and reliability, and prevents half-insertion of terminals.

The above object has been achieved by a connector of the present invention recited in the following Paragraphs.

According to one aspect of the invention, there is provided a connector including:

an inner housing receiving a terminal; and an outer housing which is attached to the inner housing in a direction of insertion of the terminal into the inner housing, wherein the terminal is received in a predetermined position within the inner housing, and the outer housing includes a pressing portion which abuts against or is closely opposed to the terminal in the direction of attaching of the outer housing.

In the invention, the terminal may have a contact portion for contact with a mating terminal at a distal end portion thereof and a proximal end portion which is thinner or more flattened than the contact portion, such that the contact portion of the terminal is firstly inserted into the inner housing; and the outer housing may further include a support portion which enters a terminal receiving chamber of the inner housing to support the proximal end portion of the terminal received in the terminal receiving chamber.

In the connector of the invention, the pressing portion of the outer housing abuts against or is closely opposed to the terminal, received in the predetermined position within the inner housing, in the direction of attaching of the outer housing. The direction of attaching of the outer housing coincides with the direction of insertion of the terminal into the inner housing. Therefore, when the terminal is not received in its predetermined position, that is, disposed in a half-inserted condition, the pressing portion of the outer housing presses the terminal in the direction of insertion thereof in accordance with the attaching of the outer housing. As a result, the half-inserted terminal can be inserted into its predetermined position simultaneously with the attaching of the outer housing, and therefore the half-insertion of the terminal can be prevented, and besides the efficiency of the assembling operation can be enhanced.

Furthermore, in the connector of the invention, the terminal has at its distal end portion the contact portion for contact with the mating terminal, and also its proximal end portion is more flattened or thinner as compared with the contact portion, and the terminal is inserted into the inner housing, with the contact portion first introduced into the inner housing. Although this construction is a typical construction of a terminal, the outer housing includes the support portion which enters the terminal receiving chamber of the inner housing to support the proximal end portion of the terminal received in the terminal receiving chamber. With this construction, the proximal end portion (which will not be restrained by partition walls forming the terminal receiving chamber) of the terminal can be supported, and the proximal end portion of the terminal is prevented from shaking and jarring, thereby enhancing the reliability.

DETAILED DESCRIPTION OF THE PREFERRED EMBODIMENTS

A preferred embodiment of a connector of the present invention will now be described with reference to the drawings.

Figure 1:
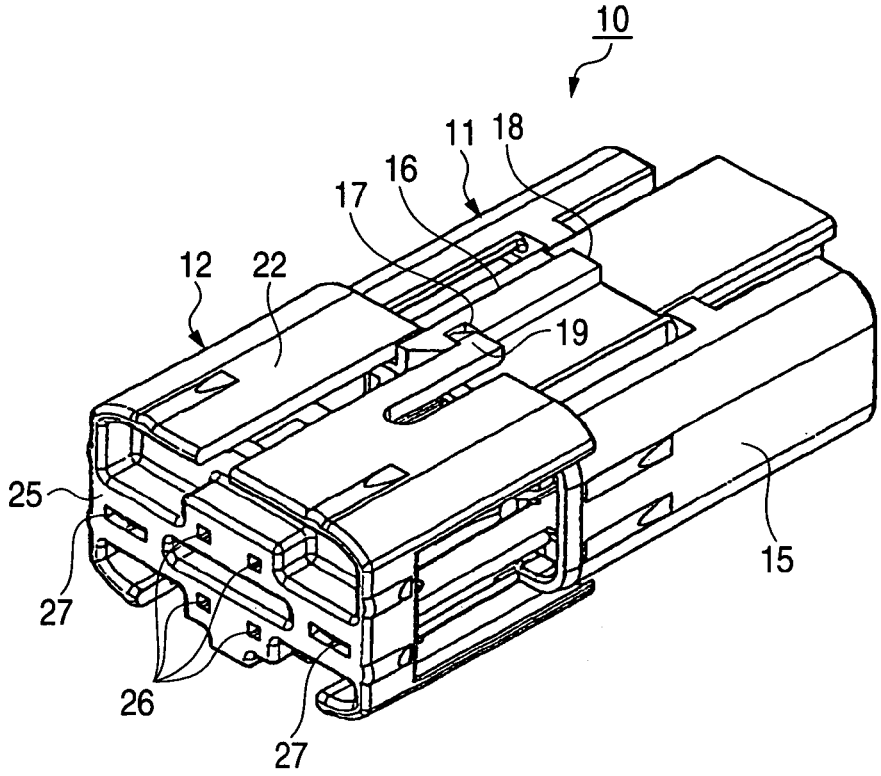
FIG. 1 is a perspective view of one preferred embodiment of a connector of the present invention, showing its appearance.
Figure 2:
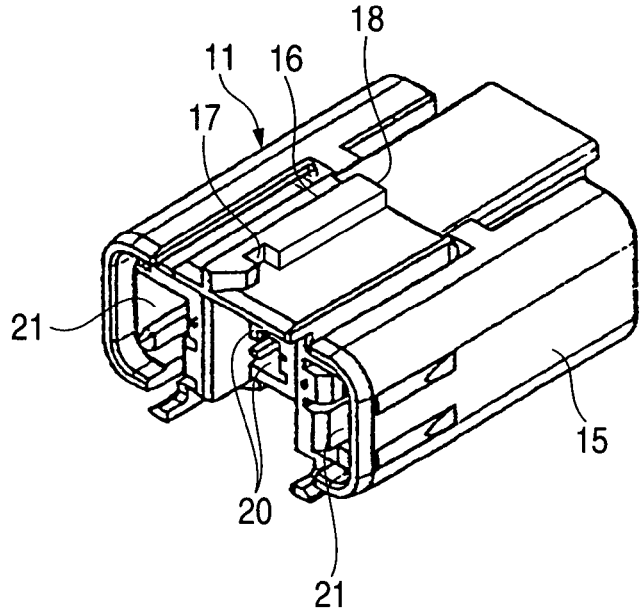
FIG. 2 is a perspective view of an inner housing of the connector of FIG. 1, showing its appearance.
Figure 3:
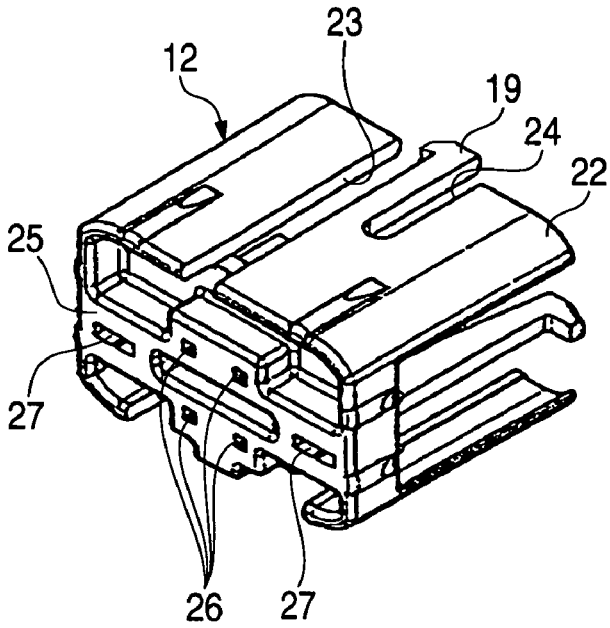
FIG. 3 is a perspective view of an outer housing of the connector of FIG. 1, showing its appearance.
Figure 4:
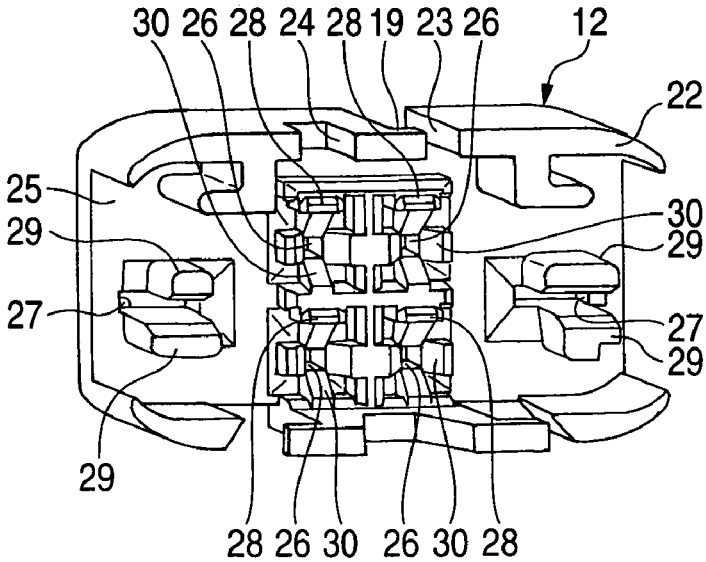
FIG. 4 is a perspective view of the outer housing of the connector of FIG. 1 as seen from an angle different from that of FIG. 3.
Figure 5:
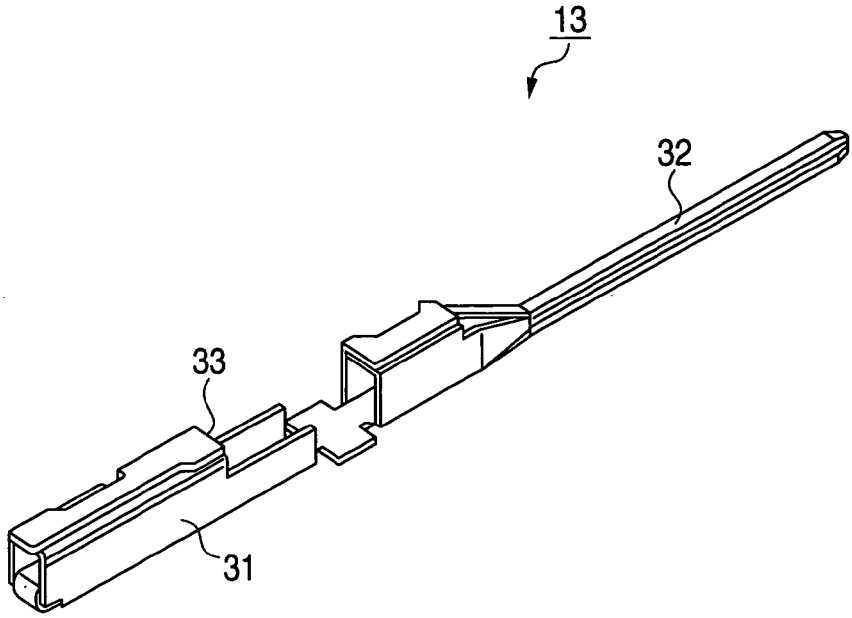
FIG. 5 is a perspective view of a first terminal to be received in the inner housing of the connector of FIG. 1.
Figure 6:
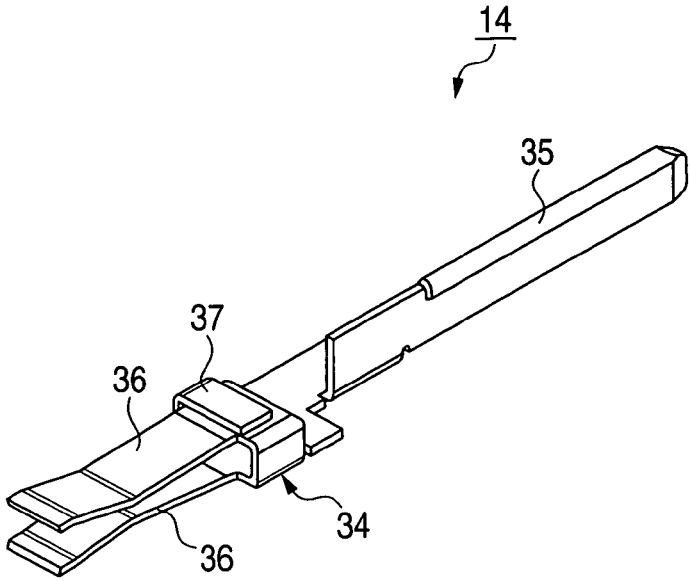
FIG. 6 is a perspective view of a second terminal to be received in the inner housing of the connector of FIG. 1.
Figure 7:
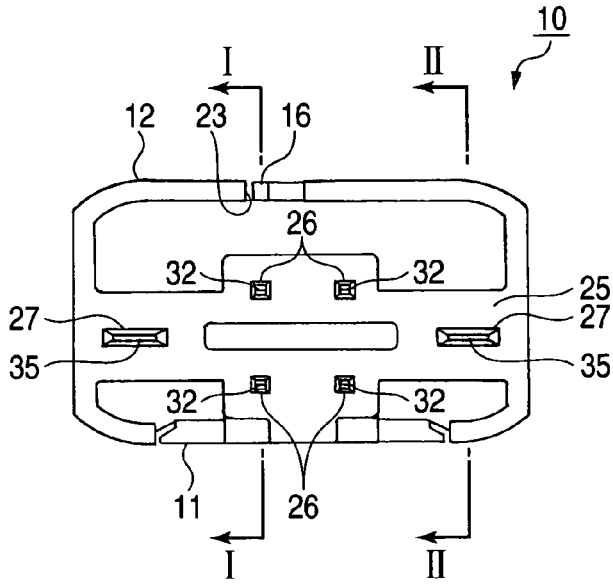
FIG. 7 is a front-elevational view of the connector of FIG. 1.
Figure 8:
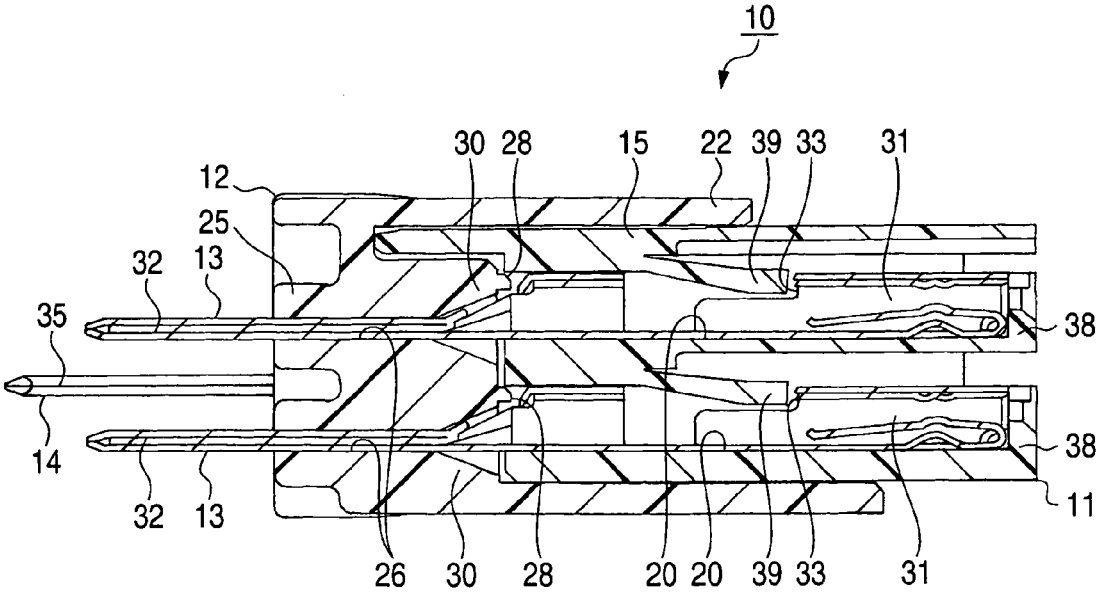
FIG. 8 is a cross-sectional view taken along the line I-I of FIG. 7.
Figure 9:
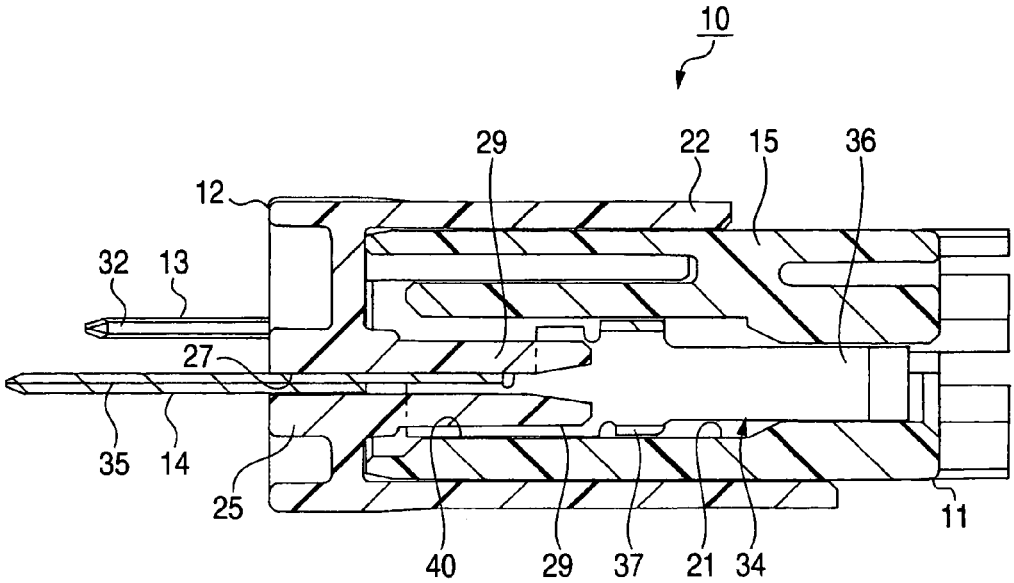
FIG. 9 is a cross-sectional view taken along the line II-II of FIG. 7.
Figure 10:
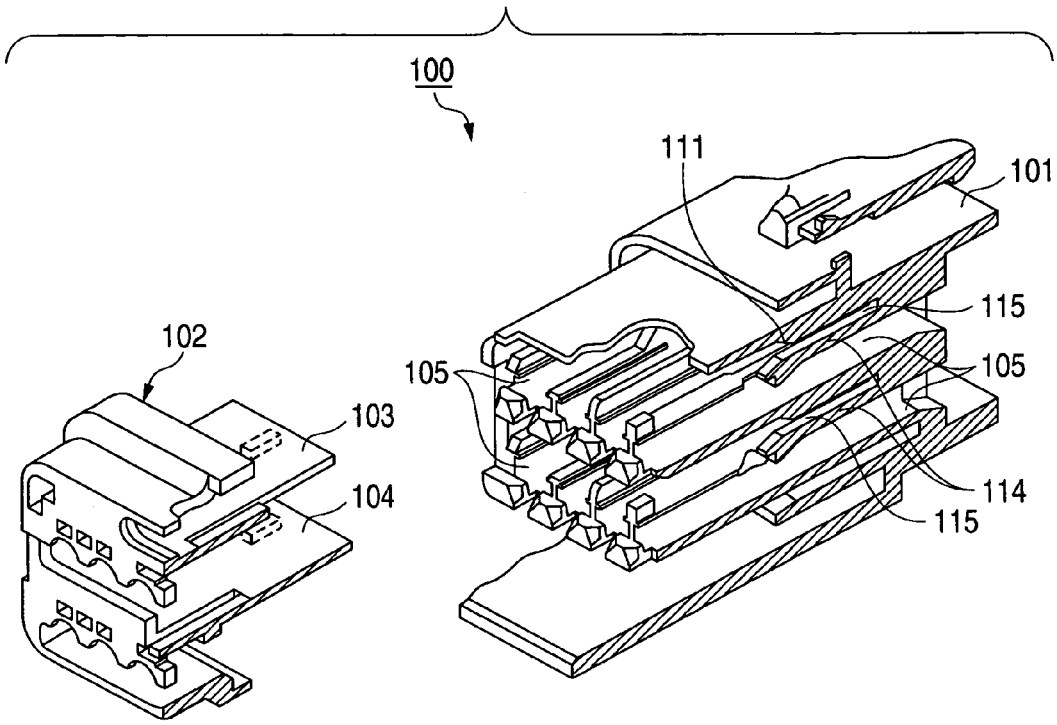
FIG. 10 is a schematic view of a conventional connector.

FIG. 1 is a perspective view of one preferred embodiment of the connector of the invention, showing its appearance, FIG. 2 is a perspective view of an inner housing of the connector of FIG. 1, showing its appearance, FIG. 3 is a perspective view of an outer housing of the connector of FIG. 1, showing its appearance, FIG. 4 is a perspective view of the outer housing of the connector of FIG. 1 as seen from an angle different from that of FIG. 3, FIG. 5 is a perspective view of a first terminal to be received in the inner housing of the connector of FIG. 1, FIG. 6 is a perspective view of a second terminal to be received in the inner housing of the connector of FIG. 1, FIG. 7 is a front-elevational view of the connector of FIG. 1, FIG. 8 is a cross-sectional view taken along the line I-I of FIG. 7, and FIG. 9 is a cross-sectional view taken along the line II-II of FIG. 7.

As shown in FIG. 1, the connector 10 of this embodiment comprises the inner housing 11, and the outer housing 12 attached to this inner housing 11.

As shown in FIG. 2, the inner housing 11 includes a tubular body 15 of a generally rectangular cross-section. Four first terminal receiving chambers 20 are formed within the body 15, and are arranged in two rows and two columns, and extend in a forward-rearward direction, that is, in a direction of an axis of the body 15. Further, two second terminal receiving chambers 21 are formed within the body 15, and are disposed respectively at opposite (right and left) sides of the group of (four) first terminal receiving chambers 20. Open portions of the four first terminal receiving chambers 20 appearing at the rear end of the inner housing 11 are joined into one large open portion at the rear end of the inner housing 11. The two second terminal receiving chambers 21 are disposed at respective positions which are rotated about the axis of the body 15 with respect to each other.

The first terminals 13 (see FIG. 5) are inserted respectively into the first terminal receiving chambers 20, and the second terminals 14 (see FIG. 6) are inserted respectively into the second terminal receiving chambers 21.

As shown in FIG. 5, the first terminal 13 is formed by cutting an electrically-conductive metal sheet into a predetermined shape and then by bending the thus cut sheet into a final shape, and a contact portion 31 for contact with a mating terminal is formed at a distal end portion of the first terminal 31, and a connection portion 32 for contact with a female terminal of a mating connector is formed at a proximal end portion of the first terminal 31.

The contact portion 31 is formed into a tubular shape with a generally square cross-section, and a tongue serving as a contact for contact with the mating terminal is formed within the contact portion 31, and a notch portion 33 is formed in a longitudinally-central portion of the contact portion 31 by notching or removing part of a peripheral wall thereof. The connection portion 32 is formed into a rod-like shape, and is thinner than the contact portion 31, and is continuous with a proximal end of the contact portion 31 with a step portion formed therebetween.

As shown in FIG. 6, the second terminal 14 is formed by cutting an electrically-conductive metal sheet into a predetermined shape and then by bending the thus cut sheet into a final shape, and a contact portion 34 for contact with a mating terminal is formed at a distal end portion of the second terminal 14, and a connection portion 35 for contact with a wire, a circuit on a printed circuit board or the like is formed at a proximal end portion of the second terminal 14.

The contact portion 34 includes a tubular base portion 37 of a generally rectangular cross-section, and a pair of gripping piece portions 36 and 36 (serving as a contact for contact with the mating terminal) extending from a distal end edge of the base portion 37. The connection portion 35 is more flattened than the base portion 37 in a direction of a width of the gripping piece portions 36, and is continuous with a proximal end of the base portion 37 with a step portion formed therebetween.

Each first terminal 13 is inserted into the first terminal receiving chamber 20 from the rear opening (appearing at the rear end of the inner housing 11), with the contact portion 31 first introduced into the terminal receiving chamber 20. Similarly, each second terminal 14 is inserted into the second terminal receiving chamber 21 from the rear opening, with the contact portion 34 first introduced into the terminal receiving chamber 21.

As shown in FIGS. 1 and 3, the outer housing 12 is attached to the inner housing 11 from the rear side of the inner housing 11 in the direction of insertion of the terminals 13 and 14 into the respective terminal receiving chambers 20 and 21. FIG. 1 shows a condition in which the outer housing 12 is provisionally fixed to the inner housing 11.

A strip-like lock portion 16 is formed in a projected manner on an upper surface of the body 15 of the inner housing 11, and extends in the forward-rearward direction, that is, in the direction of the axis of the body 15. An engagement portion 17 for provisionally fixing purposes is formed at a rear end portion of the lock portion 16, and a front end of the lock portion 16 serves as an engagement portion 18 for completely fixing purposes.

The outer housing 12 is formed into such a tubular shape as to fit on the body 15 of the inner housing 11. A receiving groove 23 is formed through an upper wall 22 of the outer housing 12 superposed on the upper surface of the body 15, and extends from a front edge of the upper wall 22 to a rear edge thereof. Also, a slit 24 is formed through the upper wall 22, and extends rearwardly from the front edge of the upper wall 22 in parallel adjacent relation to the receiving groove 23 such that a lock arm 19 is formed between the receiving groove 23 and the slit 24.

A rear end portion of the lock portion 16 formed at the body 15 of the inner housing 11 is received in the receiving groove 23 in the upper wall 22 of the outer housing 12, and also the lock arm 19 is engaged with the provisionally-fixing engagement portion 17 of the lock portion 16, thereby provisionally fixing the outer housing 12 to the inner housing 11.

Then, the outer housing 12 is further moved forward with the lock portion 16 received in the receiving groove 23 formed in the upper wall 22, so that the lock arm 19 is brought into engagement with the completely-fixing engagement portion 18 formed at the front end of the lock portion 16, thereby completely fixing (attaching) the outer housing 12 to the inner housing 11.

The rear end of the tubular outer housing 12 is closed by a bottom plate 25, and four first terminal passage holes 26 are formed through a central portion of the bottom plate 25, and also two second terminal passage holes 27 are formed through the bottom plate 25, and are disposed respectively at opposite sides of the group of (four) first terminal passage holes 26.

The outer housing 12 is moved from the provisionally-fixed position to the completely-fixed position, and at this time the connection portions 32 of the first terminals 13 received in the respective first terminal receiving chambers 20 of the inner housing 11 pass respectively through the first terminal passage holes 26, and also the connection portions 35 of the second terminals 14 received in the respective second terminal receiving chambers 21 of the inner housing 11 pass respectively through the second terminal passage holes 27.

As shown in FIG. 4, four ribs 30 are formed at and project forwardly from a peripheral edge of each first terminal passage hole 26 at an inner surface of the bottom plate 25 of the outer housing 12 in a manner to extend the first terminal passage hole 26, and are disposed generally in surrounding relation to the first terminal passage hole 26. Further, a projecting portion 28 is formed above the upper one of the four ribs 30 (surrounding each first terminal passage hole 26) in adjacent relation thereto.

Front end portions of the ribs 30 are slanting in a manner to gradually spread the first terminal passage hole 26 toward their front ends, and can guide the insertion of the connection portion 32 of the first terminal 13 into the first terminal passage hole 26. The projecting portion 28 projects forwardly beyond the ribs 30.

A pair of (two) ribs 29 are formed at and project forwardly respectively from upper and lower edges of each second terminal passage hole 27 at the inner surface of the bottom plate 25 of the outer housing 12 in a manner to extend the second terminal passage hole 27.

Next, the functions of the projecting portions 28, ribs 29 and ribs 30 will be described in detail with reference to FIGS. 8 and 9.

As shown in FIG. 8, and elastic retaining piece portion 39 is formed on and projects forwardly from an upper surface of each first terminal receiving chamber 20 of the first inner housing 11 into this chamber. A step portion 38 is formed at a front end portion of the first terminal receiving chamber 20, and this step portion 38 abuts against the front end of the contact portion 31 of the first terminal 13 completely received in the first terminal receiving chamber 20, thereby preventing forward withdrawal of the first terminal 13. When the first terminal 13 is completely received in the first terminal receiving chamber 20, with the front end of the contact portion 31 held against the step portion 38, the elastic retaining piece portion 39 is retainingly engaged with the notch portion 33, thereby preventing rearward withdrawal of the first terminal 13.

Here, if the first terminal 13 is half inserted in the first terminal receiving chamber 20, a gap is formed between the step portion 38 of the first terminal receiving chamber 20 and the front end of the contact portion 31 of the first terminal 13, and also the elastic retaining piece portion 39 of the first terminal receiving chamber 20 is not engaged with the notch portion 33 of the first terminal 13.

In this half-inserted condition of the first terminal 13, as the outer housing 12 is moved to be attached to the inner housing 11, the projecting portion 28 of the outer housing 12 is brought into abutting engagement with the step portion of the first terminal 13 formed between the contact portion 31 and the connection portion 32, that is, the proximal end of the contact portion 31, and presses and pushes the first terminal 13 forward. As a result, the half-inserted first terminal 13 is moved into a predetermined position within the first terminal receiving chamber 20, that is, a position where the front end of the contact portion 31 abuts against the step portion 38 of the first terminal receiving chamber 20, and therefore the first terminal 13 is completely received in the first terminal receiving chamber 20, with the notch portion 33 retained by the elastic retaining piece portion 39.

When the outer housing 12 is attached to the inner housing 11, the ribs 30 of the outer housing 12 enter the open portions of the four first terminal receiving chambers 20 joined into the large open portion, and the four ribs 30 for each first terminal 13 support the connection portion 32 (disposed in the open portion) of the first terminal 13 in a manner to grip this connection portion 32 from the four sides (that is, the upper, lower, right and left sides) thereof.

When each first terminal 13 is completely received in the first terminal receiving chamber 20, and the outer housing 12 is attached to the inner housing 11, each projecting portion 28 of the outer housing 12 abuts against the proximal end of the contact portion 31 of the corresponding first terminal 13 or is opposed to this proximal end with a small gap formed therebetween. Here, in order to prevent as much as possible a situation in which a load acts on the first terminal 13 after the outer housing 12 is attached to the inner housing 11, it is preferred that each projecting portion 28 of the outer housing 12 should be opposed to the proximal end of the contact portion 31 of the corresponding first terminal 13 with a small gap formed therebetween.

Similarly, in a half-inserted condition of the second terminal 14, as the outer housing 12 is moved to be attached to the inner housing 11, each pair of ribs 29 of the outer housing 12 are brought into abutting engagement with the step portion of the corresponding second terminal 14 formed between the contact portion 34 and the connection portion 35, that is, the proximal end of the base portion 37, and press and push the second terminal 14 forward. As a result, the half-inserted second terminal 14 is displaced or moved into a predetermined position within the second terminal receiving chamber 21, and therefore is completely received in the second terminal receiving chamber 21.

When the outer housing 12 is attached to the inner housing 11, each pair of ribs 29 of the outer housing 12 enter the open portion of the corresponding second terminal receiving chamber 21, and support the connection portion 35 of the second terminal 14 (disposed in the open portion) in a manner to grip this connection portion 35 from the upper and lower sides thereof.

In the connector 10 of the invention, each projecting portion 28 of the outer housing 12 abuts against or is closely opposed to the terminal 13, received in the predetermined position within the inner housing 11, in the direction of attaching of the outer housing 12, and similarly each pair of ribs 29 of the outer housing 12 abut against or are closely opposed to the terminal 14, received in the predetermined position within the inner housing 11, in the direction of attaching of the outer housing 12. The direction of attaching of the outer housing 12 coincides with the direction of insertion of the terminals 13 and 14 into the inner housing 11. Therefore, when any of the terminals 13 and 14 is not received in its predetermined position, that is, disposed in a half-inserted condition, the projecting portion 28 or the ribs 29 of the outer housing 12 press the terminal 13, 14 in the direction of insertion thereof in accordance with the attaching of the outer housing 12. As a result, the half-inserted terminal 13, 14 can be inserted into its predetermined position simultaneously with the attaching of the outer housing 12, and therefore the half-insertion of the terminals 13 and 14 can be prevented, and besides the efficiency of the assembling operation can be enhanced.

Furthermore, in the connector 10 of the invention, each terminal 13, 14 has at its distal end portion the contact portion 31, 34 for contact with the mating terminal, and also its proximal end portion 32, 35 is more flattened or thinner as compared with the contact portion 31, 34, and the terminal 13, 14 is inserted into the inner housing 11, with the contact portion 31, 34 first introduced into the inner housing 11. Although this construction is a typical construction of a terminal, the outer housing 12 includes the ribs 29 and 30 which enter the terminal receiving chambers 20 and 21 of the inner housing 11 to support the proximal end portions 32 and 35 of the terminals 13 and 14 received in the respective terminal receiving chambers 20 and 21. With this construction, the proximal end portions 32 and 35 (which will not be restrained by partition walls forming the terminal receiving chambers 20 and 21) of the terminal 13, 14 can be supported, and the proximal end portions 32 and 35 of the terminals 13 and 14 are prevented from shaking and jarring, thereby enhancing the reliability.

The present invention is not limited to the above embodiment, and suitable modifications can be made without departing from the subject matter of the invention.

What is claimed is:

1. A connector comprising:

an inner housing receiving a terminal, said inner housing including a flexible retaining piece portion for retaining the terminal in the inner housing; and an outer housing which is attached to said inner housing in a direction of insertion of said terminal into said inner housing, wherein said terminal is received in a predetermined position within said inner housing, and said outer housing includes a pressing portion which abuts against or is closely opposed to said terminal in the direction of attaching of said outer housing, wherein said terminal has a contact portion for contact with a mating terminal at a distal end portion thereof and a proximal end portion which is thinner or more flattened than said contact portion, such that said contact portion of said terminal is firstly inserted into said inner housing; and said outer housing further includes a support portion which enters a terminal receiving chamber of said inner housing to support the proximal end portion of said terminal received in said terminal receiving chamber.

* * * * *